US005979533A

United States Patent [19]

Dupuie

[11] Patent Number: 5,979,533

[45] Date of Patent: Nov. 9, 1999

[54] ADJUSTABLE SCREEN APPARATUS FOR A WINDOW AIR CONDITIONER

[76] Inventor: Rowden F. Dupuie, 14333 Ford Rd., Dearborn, Mich. 48126

[21] Appl. No.: 09/039,526

[22] Filed: Mar. 16, 1998

Related U.S. Application Data

[60] Provisional application No. 60/063,298, Oct. 27, 1997.

[51] Int. Cl.[6] ..... E06B 3/48

[52] U.S. Cl. ..... 160/84.06; 160/89; 160/240; 494/203

[58] Field of Search ..... 160/84.06, 40, 160/89, 106, 240, 244; 494/203

[56] References Cited

U.S. PATENT DOCUMENTS

| | | | |
|---|---|---|---|
| 997,947 | 7/1911 | Baldwin | 160/89 |
| 2,781,717 | 2/1957 | Hord . | |
| 3,030,873 | 4/1962 | Metcalfe . | |
| 3,111,076 | 11/1963 | Martin, Jr. et al. | 160/84.06 |
| 3,476,034 | 11/1969 | Ulich . | |
| 3,587,441 | 6/1971 | Woods . | |
| 3,811,370 | 5/1974 | Boston, Jr. et al. | 160/240 |
| 3,911,803 | 10/1975 | Kong et al. . | |
| 3,911,990 | 10/1975 | Hoover et al. | 160/28 |
| 4,453,456 | 6/1984 | Szkudlarek | 160/89 |
| 5,295,903 | 3/1994 | Bolton et al. . | |

*Primary Examiner*—Blair M. Johnson
*Attorney, Agent, or Firm*—Charles W. Chandler

[57] ABSTRACT

An adjustable screen apparatus for a window air conditioner. A framework is attached to and extends from an air conditioning unit to fill the space between the air conditioner and the window frame. The framework has three channels in the top frame member and the bottom frame member. Rods affixed to the top and bottom of the air conditioner ride in the center channel and pilot the apparatus as the apparatus is extended and retracted over and under the top and bottom of the air conditioner unit. An extensible louver fits in the inner channels while an adjustable screen fits in the outer channels. The louver can be moved from an open to a closed position. In the position that the louver is open, air can flow through the screen past the air conditioner unit.

1 Claim, 2 Drawing Sheets

ADJUSTABLE SCREEN APPARATUS FOR A WINDOW AIR CONDITIONER

CROSS REFERENCE TO RELATED PATENT APPLICATION

This is a continuation of my co-pending provisional patent application Ser. No. 60/063,298 filed on Oct. 27, 1997 and titled AN ADJUSTABLE SCREEN APPARATUS FOR A WINDOW AIR CONDITIONER.

BACKGROUND OF THE INVENTION

The field of the invention pertains to the window air conditioners. In particular, the invention pertains to a device that is adjustable for screening and closing a window opening containing a window air conditioner.

Window air conditioners provide comfort during high heat and humidity conditions. However, window openings around the air conditioner must be closed and sealed for the air conditioner to operate effectively.

Filler panels are used to fill a window opening. A disadvantage of the filler panel is that once positioned, no air flow is available around the air conditioner. When the air conditioner is operated no air flow is desirable. However, when the air conditioner is not being used, natural air flow may be desirable.

It would be convenient to be able to open or close a louver around an air conditioner. It would also be convenient to have a screen that could be employed with the louver for allowing natural air flow while limiting the entry of unwanted pests.

Examples of the known art are shown in the following U.S. Pat. No. 813,727 to Marquardt for an adjustable fly screen that tilts into the path of window sashes and then can be tilted out of the way to allow the sashes to close; U.S. Pat. No. 2,711,133 to Haskell for a window that folds in horizontal sections and locks; U.S. Pat. No. 3,111,076 to Martin, Jr., et al. for a window mounting for a room air conditioner unit; and U.S. Pat. No. 3,460,458 to MacLeod for a room air-conditioner unit with extensible filler panels that uses rods to prevent the panels from becoming dislodged.

The Marquardt patent discloses a tiltable two separate part fly screen that works with double hung windows to prevent entry of insects. The Haskell patent shows a foldable window. The Martin, Jr., et al. patent teaches a window mounting for a room air conditioner unit having louvers. The MacLeod patent shows a device for retaining extensible louvers around the air conditioner unit in the extended position. Although these patents show window opening cover devices, none show an apparatus for surrounding and sealing a window air conditioner, yet the apparatus still being openable to allow air flow around the unit through a screen.

SUMMARY OF THE INVENTION

It is an object of the invention to provide a screen apparatus for a window air conditioner that allows air flow through a screen when the air conditioner is not being used, yet allows the screened opening to be readily and easily sealed for use of the air conditioner.

The apparatus of the invention has an adjustable framework that is extended from one or both sides of a window air conditioner. The framework fits the opening between the air conditioner and the window frame. The framework has three channels on the top frame member and the bottom frame member with the center channels being designed to slide over and under the air conditioner. The inner channel contains an extensible louver while the outer channels contain a resiliently biased flexible screen. The screen is affixed to the framework and as the framework is extended to fit the window opening, the screen is also extended. The adjustable framework is locked to the window frame. The extensible louver is movable within the channel between an open and closed position. When the louver is in the closed position, the opening is sealed to allow the efficient operation of the air conditioner. When the louver is in the open position, natural air flow is allowed through the screen.

For a more complete understanding of the present invention, reference is made to the following detailed description when read with in conjunction with the accompanying drawings wherein like reference characters refer to like elements throughout the several views, in which:

DESCRIPTION OF THE PREFERRED EMBODIMENT

Figure 1:
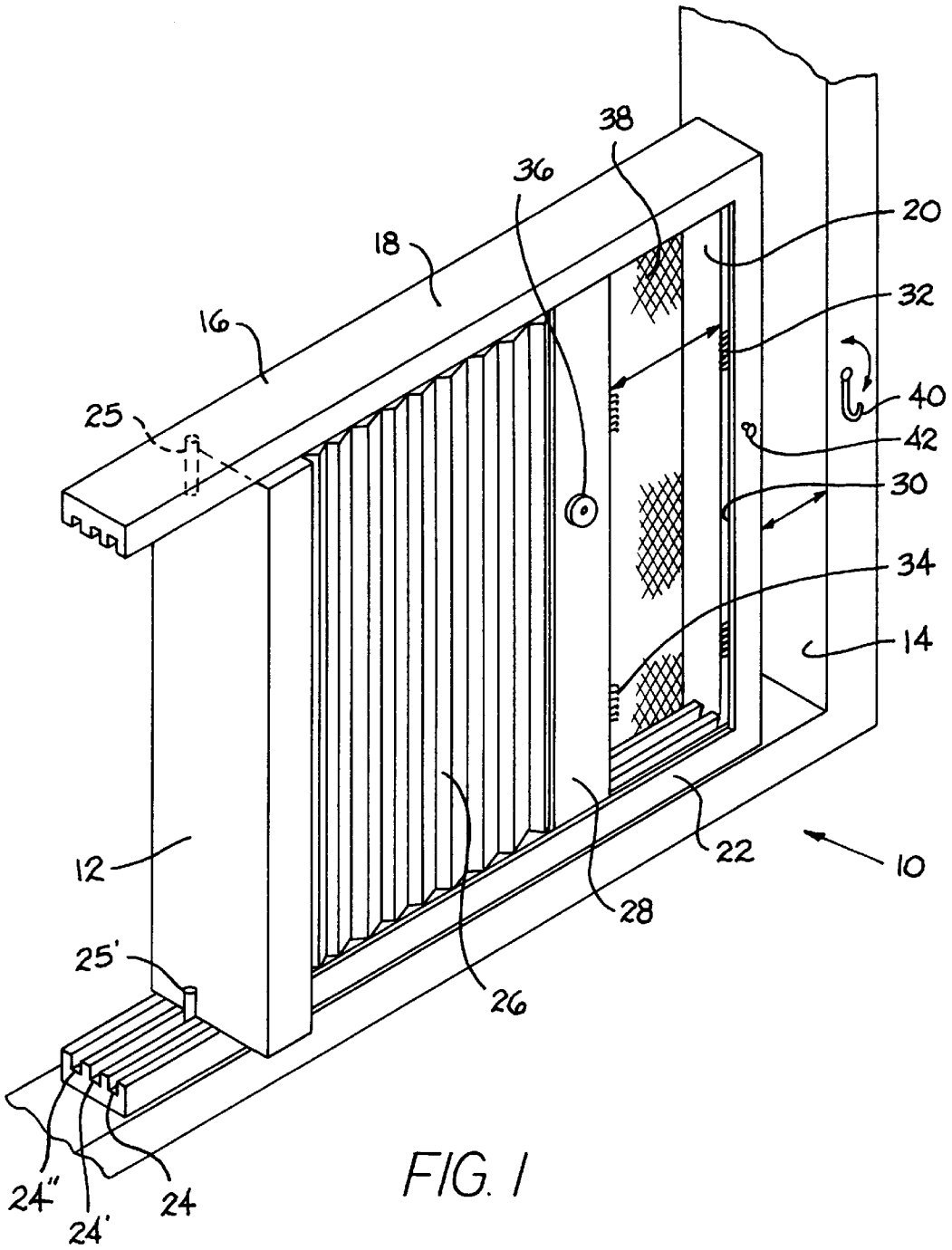
FIG. 1 illustrates a front perspective view according to the invention of an adjustable screen apparatus for a window air conditioner.
Figure 2:
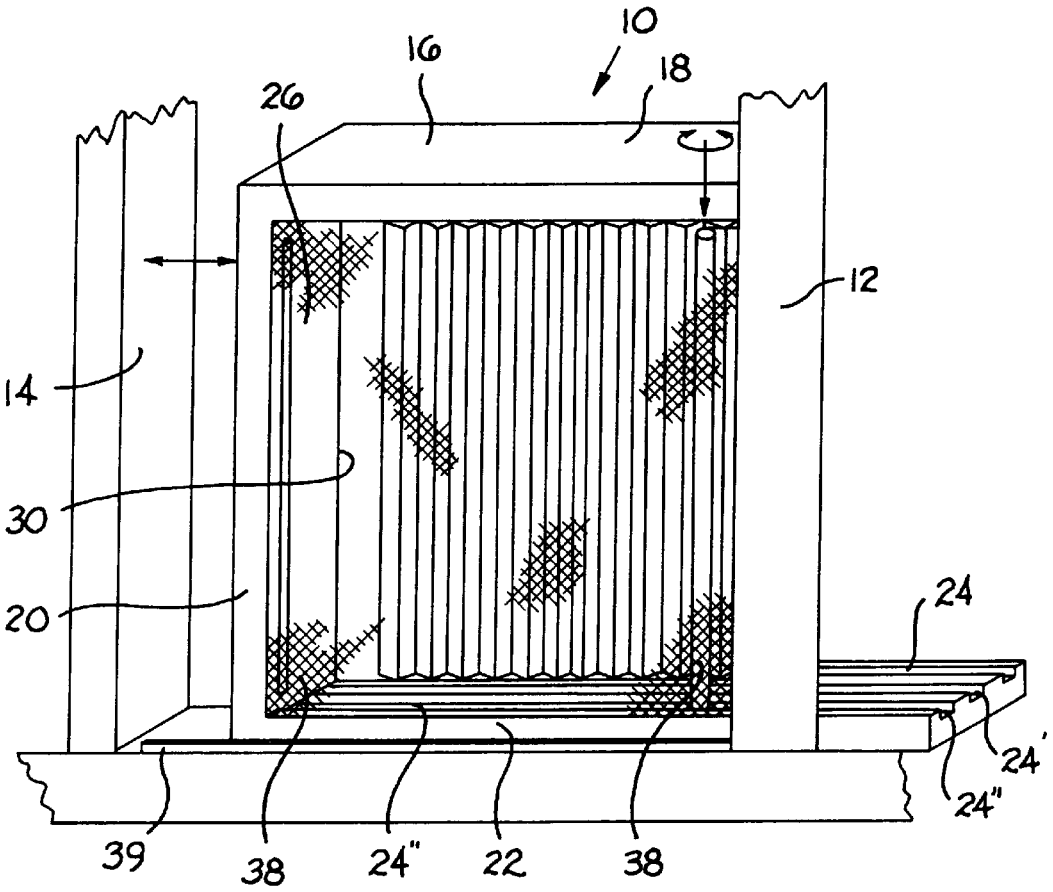
FIG. 2 illustrates a back perspective view of the invention.

FIGS. 1 and 2 show an insert apparatus generally denoted as 10. The insert apparatus 10 is for use with a window air conditioner 12 (one side of the air conditioner is shown). The insert apparatus 10 is fitted to air conditioner 12 and extendible to engage the frame 14 of a window opening.

Referring to FIG. 1, apparatus 10 comprises a framework 16 having a top frame member 18, a side frame member 20 and a bottom frame member 22. The bottom frame member 22 and the top frame member 18 have three channels 24, 24', 24". The center channels 24' engage a rod 25 on the top of the air conditioner and a rod 25' on the bottom of the air conditioner, so that framework 16 can be extended to and away from air conditioner 12. Top and bottom frame members 18 and 22 can be approximately the same length as the width dimension of the window opening.

A louver 26 for sealing the opening is disposed in the inner channels 24 nearest to the room for which the air conditioner is intended to provide cooled and dehumidified air. Louver 26 has an edge 28 and is extensible from an open position near the air conditioner 12 to a closed position with edge 28 in a channel 30 in the side frame member 20. Means for retaining 32 louver 26 in the closed position in the channel 30 in the side frame member 20 can be hook and loop fasteners 34 or other means such as mechanical fasteners. A handle 36 is mounted on the edge 28 of louver 26 to facilitate movement of the louver.

Typically louver 26 can be formed of a stiff flexible imperforate fabric having vertical fold lines spaced therealong, whereby the louver 26 can be folded or unfolded in accordance with the available space between air conditioner 12 and side frame member 20.

The upper and lower edges of the fabric louver can extend into the channels 24 in the top and bottom frame members 18 and 22, to guide and maintain louver 26 in the plane of framework 16. Alternately, the foldable fabric louver can be guided by guide pins extending from the upper and lower edges of the louver into channels 24. The louver preferably has an air seal with members 18 and 22.

Referring now to FIG. 2, a flexible retractable screen 38 is shown as fitting in the outer channels 24". One end of screen 38 is affixed to the side frame member 20. The other end of screen 38 is biased to tension and to retract screen 38 when the framework 16 is moved away from window frame 14 towards air conditioner 12. Louver 26 is shown in the closed position in channel 30 in side frame member 20.

As shown in FIG. 2, the rightmost portion of screen 38 is rolled into a spiral configuration proximate to the side surface of air conditioner 12. The spirally wound section of screen 38 can be wound on a spindle, in generally the same fashion as used with conventional window shades. Upper and lower ends of the spindle can be located within tracks 24" in frame members 18 and 20, in order to retain the screen in the framework, while allowing the screen to expand or retract in accordance with the space available between the air conditioner and side frame member 20.

A guide rail 39 on window frame 14 helps the framework 16 stay in position as it is moved in window frame 14.

Returning to FIG. 1, means 40 for locking framework 16 to the window frame are provided on side frame member 20 and window frame 14. A fabric hook and loop fastener 42 is useful but other fasteners could be employed.

Having described my invention, I claim:

1. In a window air conditioner installation wherein the air conditioner has a side surface spaced different distances from a side frame (14) of the window opening according to different air conditioner dimensions;

the improvement comprising an adjustable insert adapted to fit the vacant space formed between the air conditioner and said side frame;

said adjustable insert comprising a framework circumscribing an open area of variable dimensions, a substantially planar foldable louver mounted in said framework for movement between a closed position spanning said open area and an open position disposed at one side edge of said open area, and an air permeable screen mounted in said framework so as to span the open area in a plane paralleling said louver;

said screen having a variable face area so as to fully occupy the open area within said framework irrespective of variations in the size of said open area;

said framework comprising a top frame member (18) adapted to extend above the air conditioner, a bottom frame member (22) adapted to underlie the air conditioner, and a side frame member (20) connecting said top and bottom frame members;

said top frame member and said bottom frame member having a first set of facing channels therein; said louver comprising an imperforate flexible wall having a series of vertical fold lines, and guide elements extending from said flexible wall into said channels to guide said louver while it is being moved between its open and closed positions;

said top frame member and said bottom frame member having a second set of facing channels therein;

said air permeable screen having upper and lower edges fitting in said second set of channels;

said top frame member and said bottom frame member having a third set of facing channels therein; and pin members adapted to extend from the air conditioner into said third set of channels for maintaining said framework in a fixed orientation to the air conditioner.

* * * * *